US007698750B2

(12) United States Patent
Bullock

(10) Patent No.: US 7,698,750 B2
(45) **Date of Patent: *Apr. 20, 2010**

(54) BICYCLE HELMET WITH REINFORCEMENT STRUCTURE

(75) Inventor: Christopher Bullock, Campbell, CA (US)

(73) Assignee: Specialized Bicycle Components, Inc., Morgan Hill, CA (US)

( * ) Notice: Subject to any disclaimer, the term of this patent is extended or adjusted under 35 U.S.C. 154(b) by 764 days.

This patent is subject to a terminal disclaimer.

(21) Appl. No.: 11/425,331

(22) Filed: Jun. 20, 2006

(65) Prior Publication Data

US 2007/0277295 A1 Dec. 6, 2007

Related U.S. Application Data

(60) Provisional application No. 60/801,639, filed on May 19, 2006, provisional application No. 60/801,668, filed on May 19, 2006.

(51) Int. Cl.
*A42B 3/00* (2006.01)

(52) U.S. Cl. ..... 2/412; 2/411; 2/410

(58) Field of Classification Search ..... 2/410, 2/411, 412, 414, 416, 421
See application file for complete search history.

(56) References Cited

U.S. PATENT DOCUMENTS

| | | | | |
|---|---|---|---|---|
| 1,522,024 | A * | 1/1925 | Nixon, Jr. | 2/421 |
| 4,901,373 | A | 2/1990 | Broersma et al. | |
| 4,903,350 | A | 2/1990 | Gentes et al. | |
| 5,023,958 | A | 6/1991 | Rotzin | |
| 5,088,130 | A | 2/1992 | Chiarella | |
| 5,119,516 | A | 6/1992 | Broersma | |
| 5,123,121 | A | 6/1992 | Broersma | |
| 5,269,025 | A | 12/1993 | Broersma | |
| 5,272,773 | A | 12/1993 | Kamata | |
| 5,309,576 | A | 5/1994 | Broersma | |
| 5,351,341 | A | 10/1994 | Broersma | |
| 5,351,342 | A | 10/1994 | Garneau | |
| 5,381,560 | A | 1/1995 | Halstead et al. | |
| D361,407 | S | 8/1995 | Ho | |
| D361,409 | S | 8/1995 | Ho | |
| D361,410 | S | 8/1995 | Ho | |
| D361,411 | S | 8/1995 | Ho | |
| D363,570 | S | 10/1995 | Ho | |
| 5,477,563 | A | 12/1995 | Gentes | |

(Continued)

FOREIGN PATENT DOCUMENTS

| | | |
|---|---|---|
| EP | 0 581 460 | 2/1994 |

OTHER PUBLICATIONS

Search Report for European Patent Application No. EP 06 00 7608, dated Jun. 27, 2006.

(Continued)

*Primary Examiner*—Shaun R Hurley
*Assistant Examiner*—Andrew W Sutton
(74) *Attorney, Agent, or Firm*—Knobbe Martens Olson & Bear, LLP

(57) ABSTRACT

A bicycle helmet has a body with a concave inner surface configured to permit the helmet to fit a user's head. The helmet also includes a reinforcement structure having a plurality of separate frames interconnected with each other, at least one of the plurality of frames comprising a unidirectional filament, wherein the reinforcement structure engages the body.

26 Claims, 16 Drawing Sheets

U.S. PATENT DOCUMENTS

| | | | | |
|---|---|---|---|---|
| D366,538 | S | 1/1996 | Ho | |
| 5,481,762 | A | 1/1996 | Gentes | |
| 5,519,895 | A | 5/1996 | Barnes, Jr. | |
| 5,551,094 | A | 9/1996 | Navone | |
| 5,581,819 | A | 12/1996 | Garneau | |
| 5,598,588 | A | 2/1997 | Lee | |
| 5,619,756 | A | 4/1997 | Garneau | |
| 5,745,923 | A | 5/1998 | Katz | |
| 5,794,271 | A | 8/1998 | Hastings | |
| 5,794,272 | A | 8/1998 | Workman et al. | |
| 5,867,840 | A | 2/1999 | Hirosawa | |
| 5,887,288 | A | 3/1999 | Arney et al. | |
| 5,915,537 | A | 6/1999 | Dallas et al. | |
| 6,012,178 | A | 1/2000 | Shuster | |
| 6,029,269 | A * | 2/2000 | El-Soudani | 2/2.5 |
| 6,070,271 | A | 6/2000 | Williams | |
| 6,292,952 | B1 | 9/2001 | Watters | |
| 6,292,954 | B1 * | 9/2001 | O'Bradaigh et al. | 2/424 |
| 6,343,385 | B1 | 2/2002 | Katz | |
| 6,401,261 | B1 | 6/2002 | Arney et al. | |
| 6,425,141 | B1 | 7/2002 | Ewing | |
| 6,425,142 | B2 | 7/2002 | Sasaki et al. | |
| 6,532,602 | B2 | 3/2003 | Watters | |
| 6,550,071 | B2 | 4/2003 | Garneau | |
| 6,604,246 | B1 | 8/2003 | Obreja | |
| D482,501 | S | 11/2003 | Ho | |
| D495,835 | S | 9/2004 | Ho | |
| D495,836 | S | 9/2004 | Fang | |
| 7,069,601 | B1 | 7/2006 | Jacobsen | |
| 2001/0022005 | A1 | 9/2001 | Sasaki et al. | |
| 2002/0023291 | A1 | 2/2002 | Mendoza | |
| 2002/0124298 | A1 | 9/2002 | Muskovitz | |
| 2003/0139104 | A1 | 7/2003 | Arai | |
| 2003/0221245 | A1 | 12/2003 | Lee et al. | |
| 2006/0248630 | A1 | 11/2006 | Bullock | |
| 2007/0220662 | A1 | 9/2007 | Pierce | |
| 2008/0141429 | A1 * | 6/2008 | Scharpenack et al. | 2/2.5 |

OTHER PUBLICATIONS

U.S. Appl. No. 11/425,350, filed Jun. 20, 2006, Bullock.
European Search report received in European Application No. 07 00 9829.

* cited by examiner

BICYCLE HELMET WITH REINFORCEMENT STRUCTURE

CROSS-REFERENCE TO RELATED APPLICATIONS

This application claims the benefit of U.S. Provisional Application No. 60/801,639, filed May 19, 2006, titled BICYCLE HELMET WITH REINFORCEMENT STRUCUTRE, and the benefit of U.S. Provisional Application No. 60/801,668, filed May 19, 2006, titled BICYCLE HELMET WITH REINFORCEMENT STRUCUTRE, the entire contents of both of which are incorporated by reference and should be considered a part of this specification.

BACKGROUND OF THE INVENTION

1. Field of the Invention

The present invention relates to protective helmets and bicycle helmets in particular. More specifically, the present invention relates to a helmet with a unidirectional filament internal reinforcement structure.

2. Description of the Related Art

Conventional bicycle helmets typically employ a layer of crushable material, usually synthetic resin foam, extending over and about the wearer's head to mitigate the force of an impact, for example, due to a fall. Conventional helmets also sometimes include an outer shell attached to the layer of crushable material, which serves to increase the impact strength of the helmet, and serves as a structural support for the crushable material. Other helmet designs include materials of different densities covered by an outer shell. However, both these approaches tend to increase the overall weight of the helmet. Additionally, increasing the addition of a shell increases the thickness of the helmet, making it more bulky.

Accordingly, there is a need for a helmet design that provides a desired structural support with minimal increase in the overall weight of the helmet.

SUMMARY OF THE INVENTION

Preferred embodiments of the present invention provide an improved bicycle helmet and methods of making the same. Preferably, the improved helmet includes a reinforcement structure comprising a frame of unidirectional filament, which may be continuous. The reinforcement structure is embedded into a body, which can be of an expanded foam material, so that the reinforcement structure engages the body.

In accordance with one embodiment, a bicycle helmet is provided comprising a body having a concave inner surface configured to permit the helmet to fit a user's head. The helmet also comprises a reinforcement structure comprising a plurality of frames interconnected with each other, at least one of the plurality of frames comprising a unidirectional filament, wherein the reinforcement structure engages the body.

In accordance with another embodiment, a bicycle helmet is provided. The helmet comprises a body having a concave inner surface configured to permit the helmet to fit a user's head, and a reinforcement structure embedded in the body. The reinforcement structure comprises a continuous unidirectional filament, wherein the unidirectional filament engages the body.

In accordance with yet another embodiment, a method for manufacturing a bicycle helmet is provided. The method comprises forming a reinforcement structure comprising a plurality of frames interconnected with each other, the reinforcement structure comprising a unidirectional filament. The method also comprises embedding the reinforcement structure in a body having a concave inner surface and a convex outer surface, the reinforcement structure engaging at least a portion of the body.

BRIEF DESCRIPTION OF THE DRAWINGS

These and other features, aspects and advantages of the present protective helmet are described in greater detail below with reference to several preferred embodiments, which are intended to illustrate, but not to limit the present invention. The drawings contain 17 figures.

DETAILED DESCRIPTION OF THE PREFERRED EMBODIMENT

Figure 1A:
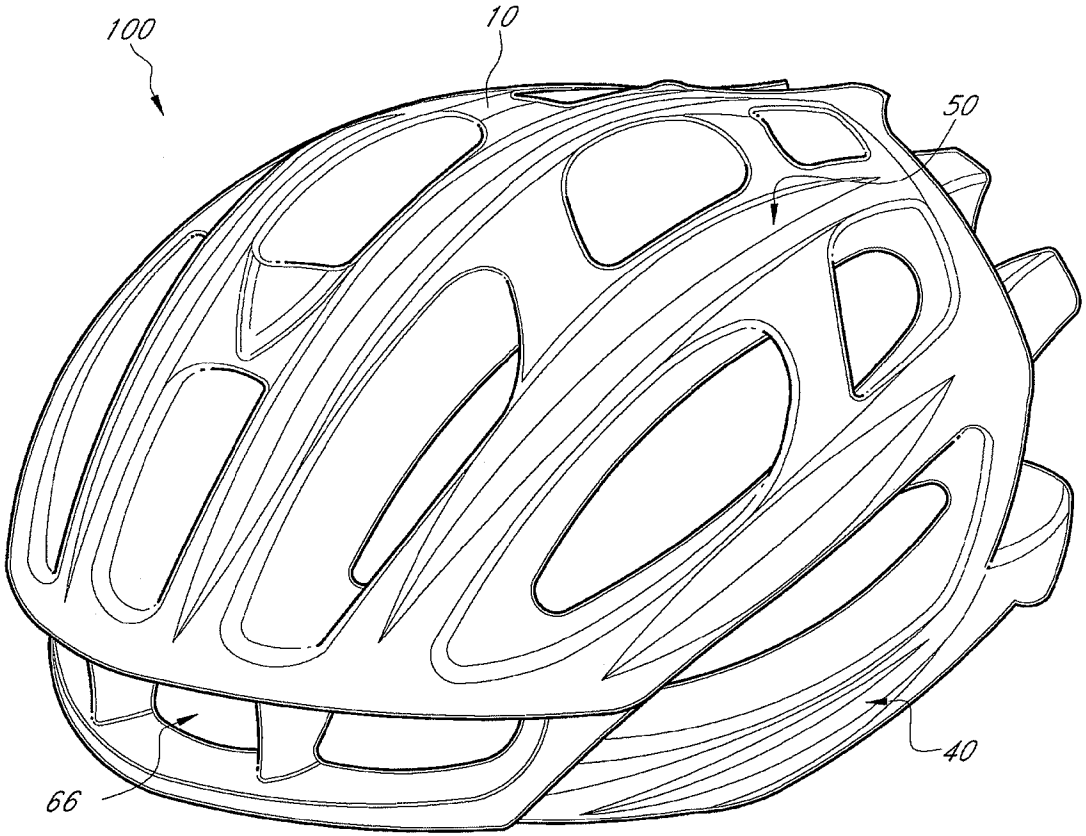
FIG. 1A is a schematic front perspective view of a bicycle helmet incorporating one embodiment of a reinforcement structure.

In the following detailed description, terms of orientation such as "top," "bottom," "upper," "lower," "front," "rear," "left," "right" and "center" are used herein to simplify the description of the context of the illustrated embodiments. Likewise, terms of sequence, such as "first" and "second," are used to simplify the description of the illustrated embodiments. Because other orientations and sequences are possible, however, the present invention should not be limited to the illustrated orientation. Those skilled in the art will appreciate that other orientations of the various components described above are possible. As used herein, "front", "rear", "left" and "right" are interpreted from the point of view of a user of a protective helmet. Likewise, "top", "bottom", "upper" and "lower" are interpreted from the point of view of the wearer of the helmet.

FIGS. 1A-1E illustrate one preferred embodiment of a protective helmet, which is especially well suited for use as a bicycle helmet 100. The helmet 100 includes a body 10, which preferably is a composite structure. The helmet body 10 preferably makes up the protective, impact resistant portion of the helmet 100. In the illustrated arrangement, the body 10 includes a front end 12, a rear end 14, a bottom edge 16 and a top end 18. Additionally, the body includes a left side 20 and a right side 30. The helmet body 10 also preferably defines a cavity sized to permit the body 10 to fit on a user's head. For example, the cavity can have a concave surface that at least partially surrounds a portion of the user's head when wearing the helmet 100. In one preferred embodiment, the body 10 is sized so that the bottom edge 16 on the left and right sides 20, 30 sits proximal the user's ears, and so the rear end 14 sits at or below the user's skull when wearing the helmet 100. Further, as known in the art, the helmet body 10 can have a variety of sizes in order to fit the variety of head-sizes in the user population. For example, in one embodiment the helmet 100 can be sized to fit children. In another embodiment, the helmet 100 can be sized to fit adults. In still another embodiment, the helmet 100 can be sized to fit a range of head sizes.

Figure 1B:
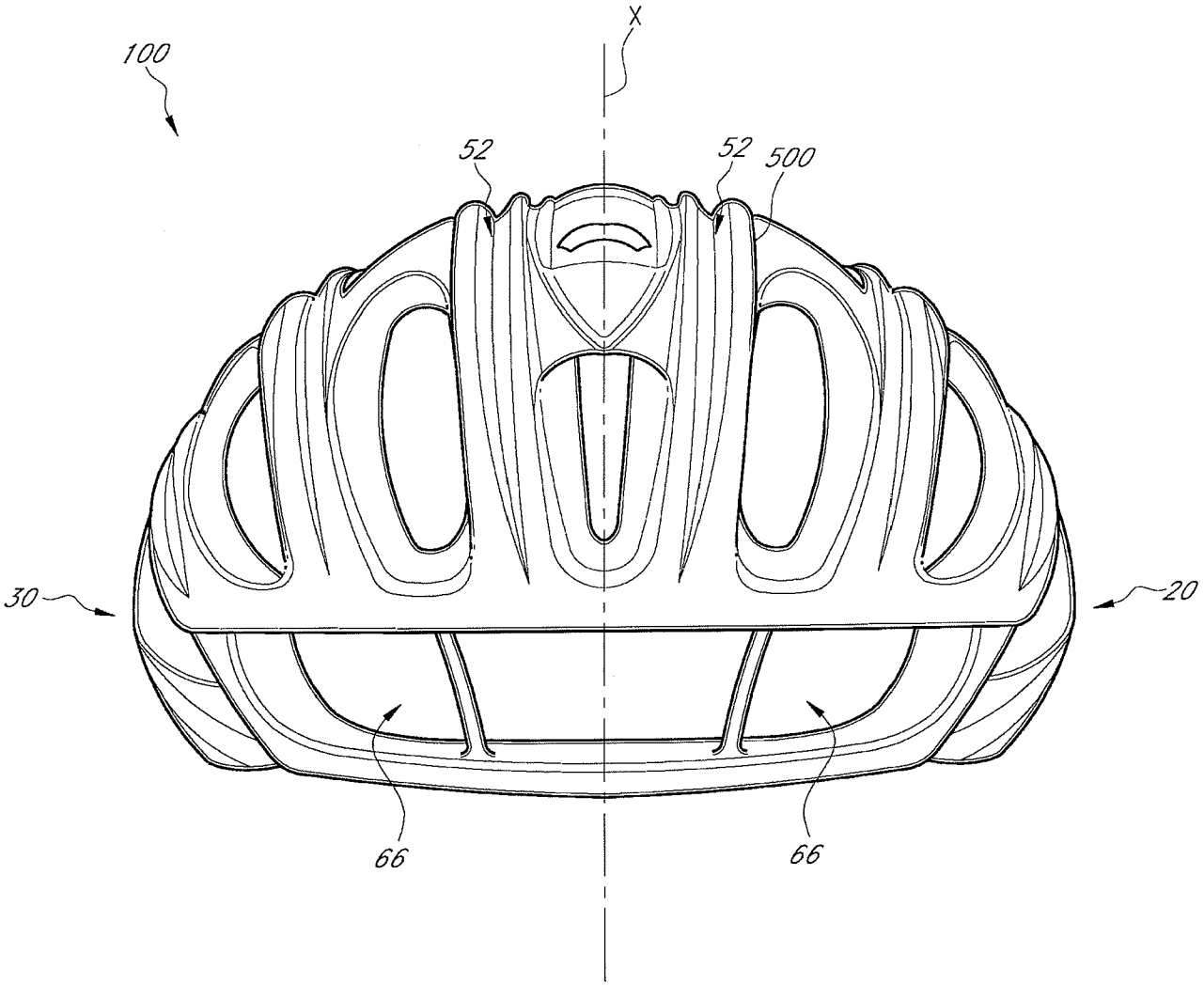
FIG. 1B is a schematic front view of the bicycle helmet in FIG. 1A.
Figure 1C:
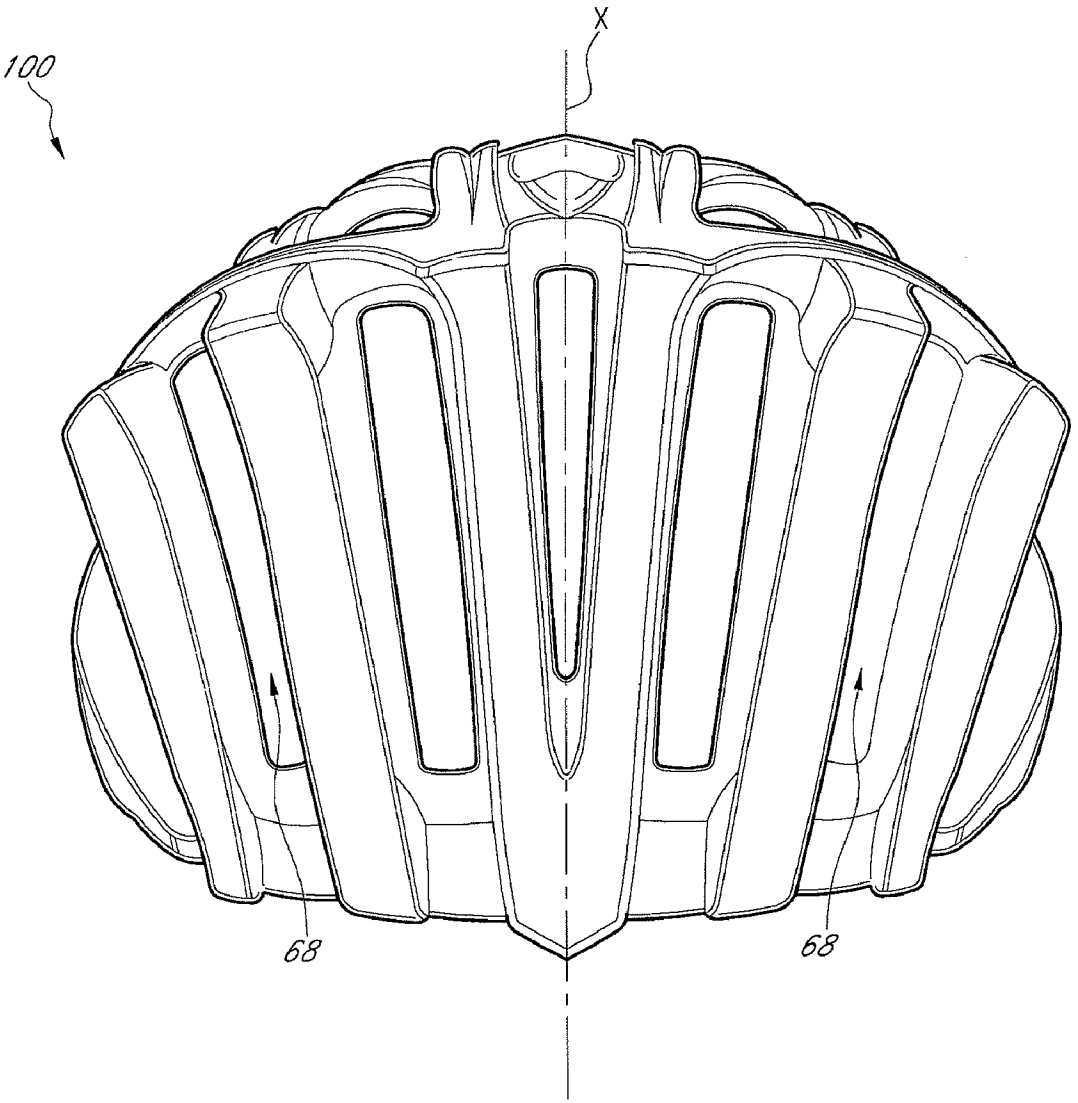
FIG. 1C is a schematic rear view of the bicycle helmet in FIG. 1A.

The helmet body 10 preferably defines a bottom section 40 and a top section 50. In the illustrated embodiment, the bottom section 40 is defined below a dotted line (See FIG. 1D) and extends from the rear end 14 to a point P proximal the front end 12 of the body 10. The helmet body 10 is preferably symmetrical about a longitudinal axis X, as shown in FIGS. 1B, 1C and 1F, so that the left side 20 and right side 30 of the body 10 are mirror images of each other. In another embodiment, the bottom section 40 extends from the rear end 14 to the front end 12.

With continued reference to FIGS. 1A-1E, a number of openings 60 are formed in the helmet body 10, where the openings 60 are configured to allow air to flow therethrough to advantageously cool the head of a user wearing the helmet 100. In the illustrated embodiment, the helmet body 10 has at least one air opening 62 formed between the bottom and top sections 40, 50 of the body 10. In the illustrated embodiment, two openings 62 are formed at a boundary between the bottom and top sections 40, 50. The openings 62 are preferably elongated and are arranged in a longitudinal direction between the front end 12 and the rear end 14 of the body 10. Additionally, a recess 62*a* in the body 10 is disposed adjacent each opening 62 and configured to guide air toward the opening 62. However, the openings 62 can be arranged in other suitable patterns.

Figure 1D:
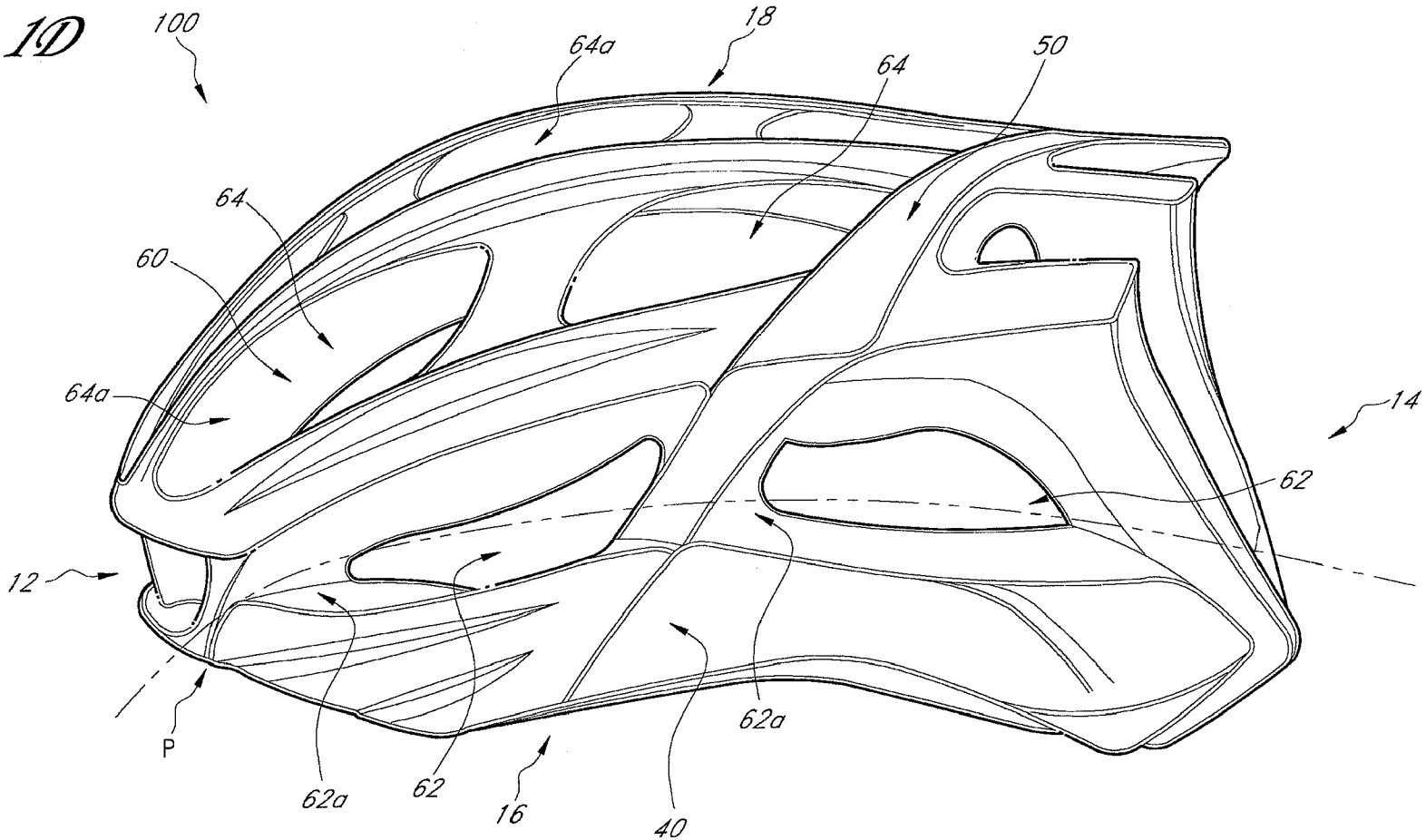
FIG. 1D is a schematic left-side view of the bicycle helmet in FIG. 1A.
Figure 1E:
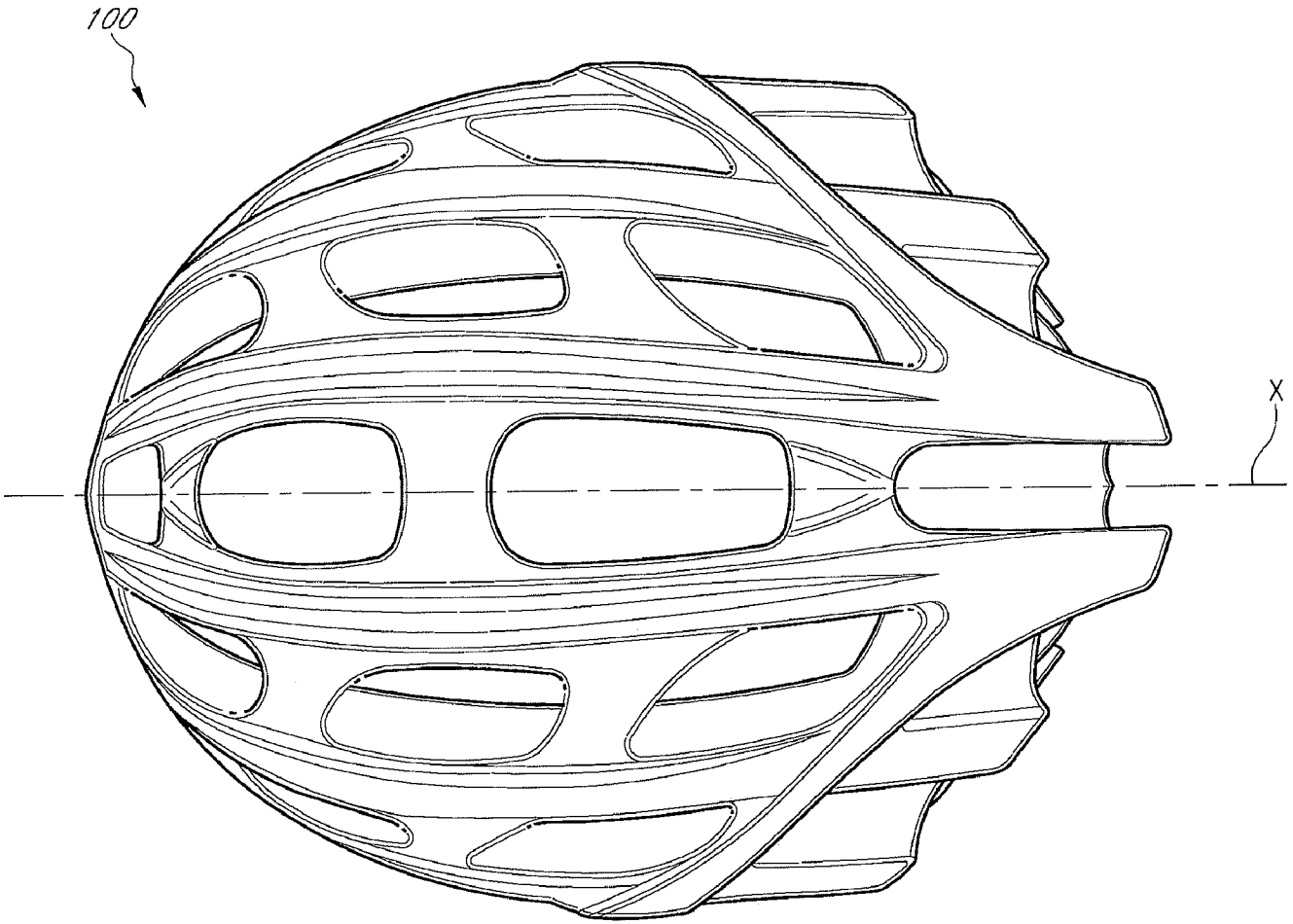
FIG. 1E is a schematic top view of the bicycle helmet in FIG. 1A.

FIG. 1D also illustrates a plurality of openings 64 formed in the top section 50 of the body 10. Preferably, the openings 62, 64 are sized to direct a desired amount of airflow to a user's head. The openings 64 are likewise elongated and arranged in a longitudinal direction between the front end 12 and the rear end 14 of the body 10. However, the openings 64 can be arranged in other suitable patterns. The top section 50 also has recesses 64*a* formed therein, one of said recesses 64*a* disposed adjacent each opening 64. As discussed above, the recesses 64*a* are configured to guide airflow to the openings 64 and onto a user's head. The top section 50 includes at least one elongated support member 52 between adjacent series of openings 64. The support member 52 preferably extends longitudinally between the front end 12 and the rear end 14 of the helmet body 10.

The body 10 also has an opening 66 formed at the front end 12 thereof. In the illustrate embodiment, three openings 66 are shown. However, any the body 10 can have any suitable number of openings 66. The opening 66 preferably defines a slot above the bottom edge 16 that extends laterally from the left side 20 to the right side 30 of the body 10. Preferably, the opening 66 allows air to flow therethrough at least partially onto a user's forehead when the helmet 100 is worn by the user. In one embodiment, the body 10 also preferably has an opening 68 formed at the rear end 14 thereof, as shown in FIG. 1C. In the illustrated, the body 10 has three openings 66 at the front end 12 and five openings 68 at the rear end 14. In another embodiment, more or fewer than three openings 66 can be provided at the front end 12 and more or fewer than five openings 68 can be provided at the rear end 14. In the illustrated embodiment, the openings 66 at the front end 12 are elongated and extend between the left and right sides 20, 30 of the helmet body 10. Likewise, the openings 68 at the rear end 14 are preferably elongated.

The helmet body 10 is preferably manufactured from an energy absorbing material, such as an expanded foam material. However, other suitable materials may also be used. Additionally, in one embodiment, the helmet body 10 is constructed of different parts of expanded foam material, each part having a different foam density. For example, in one embodiment the bottom section 40 can be constructed of a first foam density and the top section 50 can be constructed of a second foam density different than the first foam density. One example of a helmet body constructed of different parts of expanded foam material with different foam densities is discussed in co-pending application Ser. No. 11/425,350, titled BICYCLE HELMET WITH REINFORCEMENT STRUCTURE and filed on Jun. 20, 2006, the entire contents of which are hereby incorporated by reference and should be considered a part of this specification. In another embodiment, the helmet body 10 is constructed of a single piece of material having a generally uniform material density.

Figures 2A, 2B:
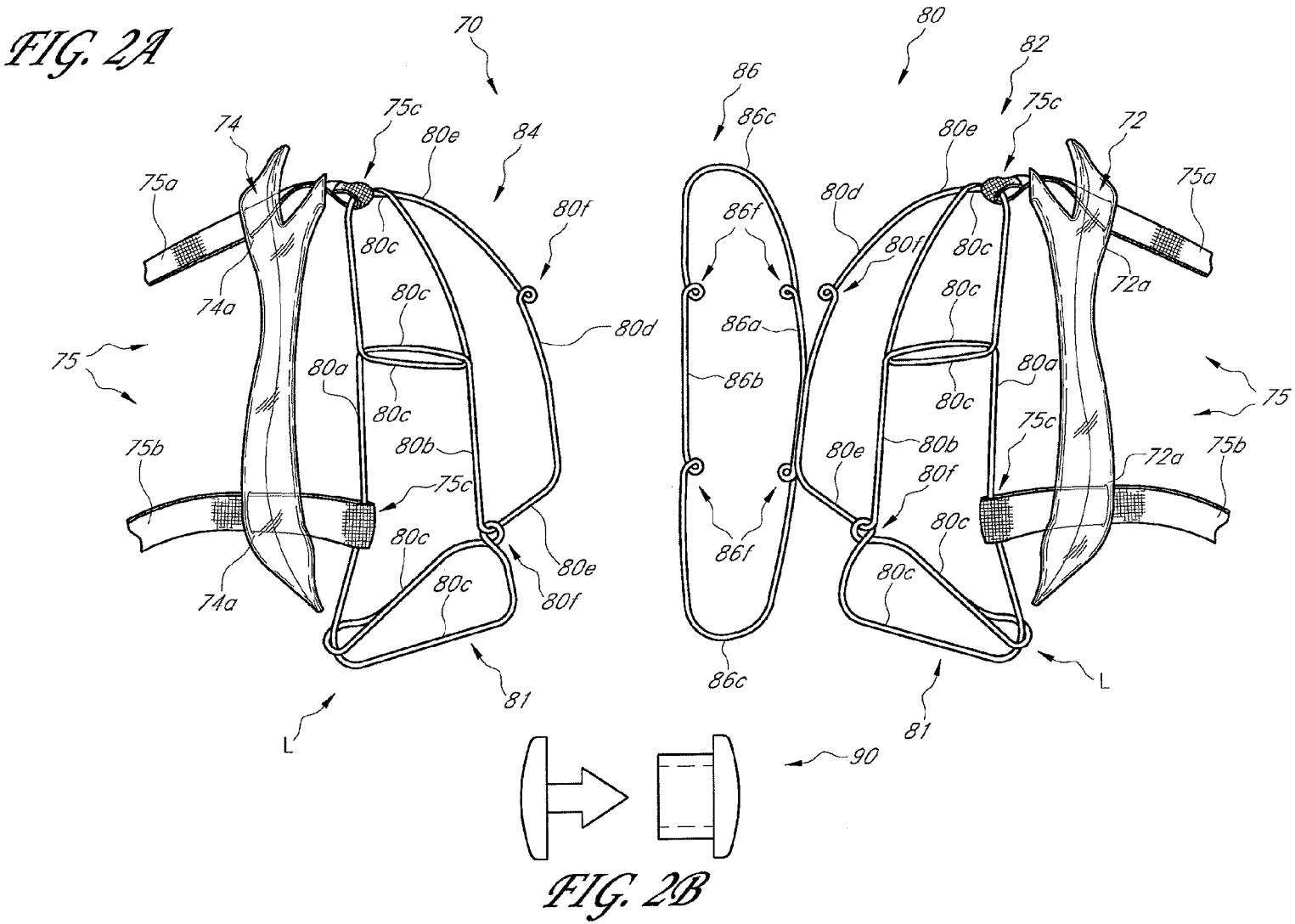
FIG. 2A is a schematic side view of one embodiment of a reinforcement structure used for manufacturing the bicycle helmet of FIG. 1A.
FIG. 2B is a schematic side view of one embodiment of a fastener used to interconnect different parts of the reinforcement structure in FIG. 2A.

FIG. 2A illustrates one embodiment of a frame 70 for use in constructing a helmet, such as the helmet 100 discussed above. The frame 70 preferably includes a tray having a cavity sized to receive foam thereabout, as further described below. In the illustrated embodiment, the frame 70 includes a right-side tray 72 and a left-side tray 74. In a preferred embodiment, the right-side and left-side trays 72, 74 are mirror images of each other. In one embodiment, the trays 72, 74 are made of a plastic material. However, the trays 72, 74 can be made of other suitable light-weight materials. Preferably, the trays 72, 74 have a shape corresponding to the section of the helmet body 10 to be molded. In the illustrated embodiment, the right and left trays 72, 74 have the same shape as the right and left sides of the bottom section 40 of the helmet body 10, respectively.

The right-side and left-side trays 72, 74 preferably include openings 72*a*, 74*a*, respectively, through which straps 75 can extend. The straps 75 can be made of nylon or other suitable materials for use with protective helmets. Additionally, the straps 75 can be arranged to securely fasten the constructed helmet 100 on a user's body. For example, the straps can include front straps 75*a* and rear straps 75*b*, wherein the front and rear straps 75*a*, 75*b* together maintain the constructed helmet 100 in generally fixed relationship to the user's head. The straps 75*a*, 75*b* of the right-side and left-side trays 72, 74 can be fastened to each other in any suitable manner to maintain the constructed helmet generally in place on a user's head. Each of the straps 75*a*, 75*b* preferably has a closed end 75*c* at one end thereof. In the illustrated embodiment, the closed end 75*c* of the strap 75*a*, 75*b* is disposed in the cavity of the tray 72, 74. In one embodiment, the closed end 75*c* includes a passage defined by portions of the strap 75*a*, 75*b* fastened together with stitches. However, the closed end 75*c* can be defined by fastening the strap 75*a*, 75*b* in other suitable ways, such as with an adhesive.

With continued reference to FIG. 2A, the frame 70 includes a reinforcement structure 80. In the illustrated embodiment, the reinforcement structure 80 is a structure of flexible linear material 81. In one embodiment, the reinforcement structure 80 includes a structure of composite material, preferably having unidirectional fiber orientation. In another embodiment, the reinforcement structure 80 is a hand-laid filament. However, the arrangement of the filament can be produced using other suitable mechanisms, such as an automated lay-up process. In on embodiment, the filament includes Kevlar with an epoxy resin. In other embodiments, the filament can include carbon, fiberglass or a combination of one of these materials. For example, in one embodiment the filament can include Kevlar and carbon. In another embodiment, the filament can include Kevlar, carbon and fiberglass. Other suitable filament materials can also be used. In a preferred embodiment, the filament has a flexible unidirectional fiber orientation, allowing a frame to be formed by shaping a unitary filament into a desired layout structure. However, the reinforcement frame can include other suitable configurations, such as a rigid or semi-rigid frame. In the illustrated embodiment, the reinforcement structure 80 includes a right-side frame 82, a left-side frame 84 and a top frame 86.

In the illustrated embodiment, the right-side and left-side frames 82, 84 preferably have the same layout. Accordingly, the following description of the layout is applicable to both the right-side and left-side frames 82, 84. The layout L preferably includes a plurality of elongated members, with at least one extending longitudinally along at least a portion of the length of the tray 72, 74 and at least one extending generally transverse thereto. In the illustrated embodiment, the layout L includes a first elongated member 80*a* extending generally longitudinally along substantially the entire length of the tray 72, 74. As shown in FIG. 2A, the first elongated member 80*a* extends through the passages in the straps 75*a*, 75*b*. Accordingly, the straps 75*a*, 75*b* are coupled to the reinforcement structure 80 via the first elongated members 80*a*. The layout L also includes a second elongated member 80*b* extending generally longitudinally along substantially the entire length of the tray 72, 74 and generally parallel to the first elongated member 80*a*. The second elongated member 80*b* preferably attaches to the first elongated member 80*a* via transverse members 80*c* extending therebetween. The layout L also includes a third elongated member 80*d* extending generally longitudinally along a portion of the length of the tray 72, 74 and generally parallel to the second elongated member 80*b*. The third elongated member 80*d* preferably attaches to the second elongated member 80*b* via second transverse members 80*e* extending therebetween. As shown in FIG. 2A, the layout also includes junctions 80*f* along the length of the second and third elongated members 80*b*, 80*d*, as well as at a junction between the second elongated member 80*b* and the transverse members 80*c*, 80*e*. Preferably, the elongated members 80*a*, 80*b*, 80*d* and transverse members 80*c*, 80*e* at least partially define the openings 60 in the completed helmet body 10.

Figure 3:
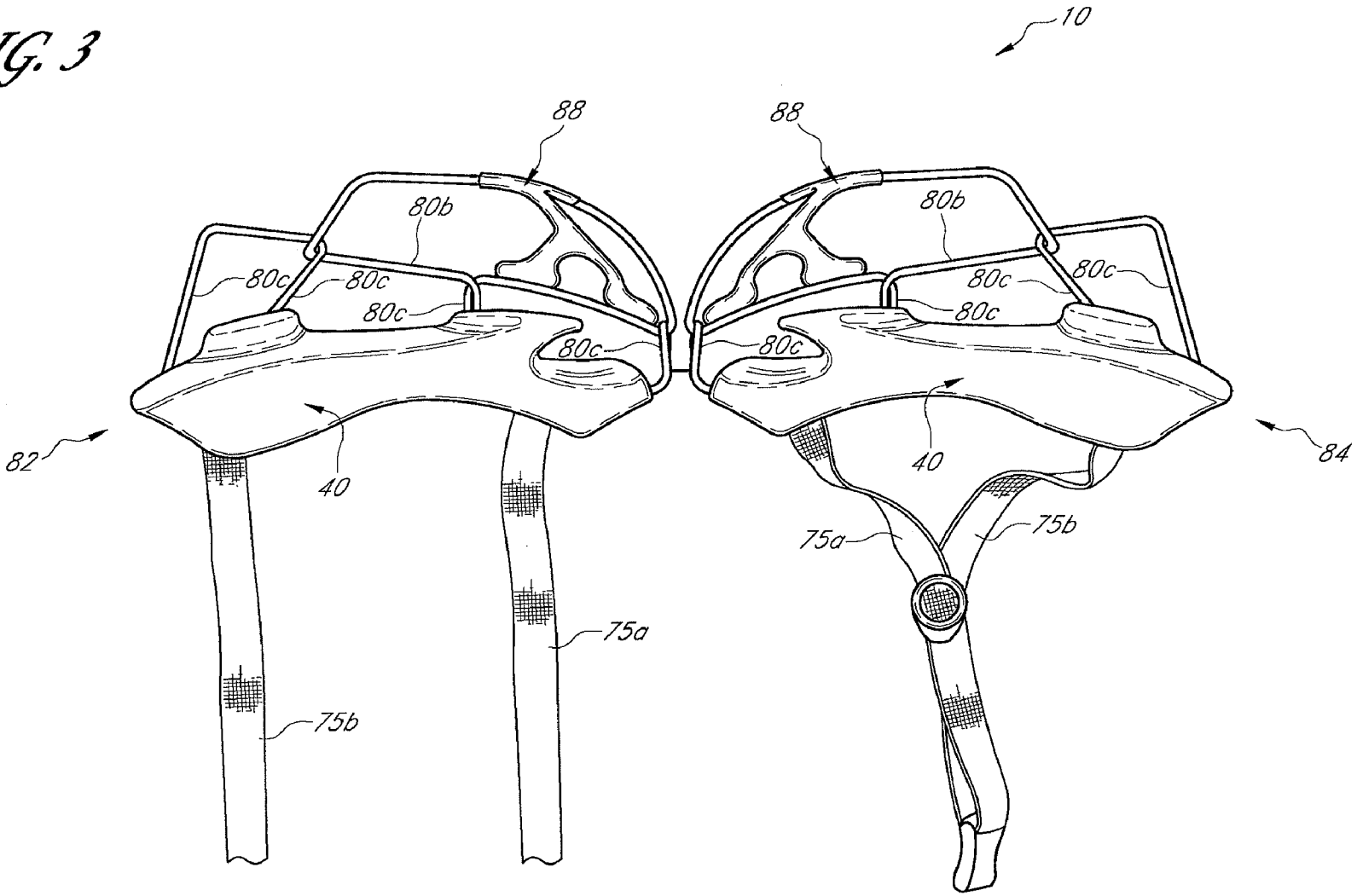
FIG. 3 is a schematic side view of a partially formed bicycle helmet with a bottom foam portion of a pre-selected density molded about the reinforcement structure of FIG. 2A.

In one embodiment, a reinforcement member 88 extends between the third elongated member 80*d* and the second elongated member 80*b* (see FIG. 3). The reinforcement member 88 is preferably positioned proximal a front end of the layout L. In the illustrated embodiment, the reinforcement member 88 has an upside-down Y shape. However, the reinforcement member 88 can have other suitable shapes. Advantageously, the reinforcement member 88 provides additional stiffness to the right-side and left-side frames 82, 84. Preferably, the reinforcement member 88 is made of a light-weight and stiff material, such as a hard plastic. In one embodiment, the reinforcement member 88 fastens to the right-side and left-side frames 82, 84 via the junctions 80*f*, as further described below. In other embodiments, other mechanisms can be used to fasten the reinforcement member 88 to the right-side and left-side frames, such as an adhesive. However, the reinforcement member 88 is optional, and in other embodiments the reinforcement structure 80 can be constructed without the use of such a reinforcement member 88, as shown in FIGS. 4A-4E below.

In one embodiment, shown in FIG. 2A, the elongated members 80*a*, 80*b*, 80*d* and transverse members 80*c*, 80*e* are preferably made of a single unidirectional linear material, which can be a single continuous filament. For example, the linear material can be shaped to define the elongated members 80*a*, 80*b*, 80*c* and the transverse members 80*c*, 80*e*. In one embodiment, the linear material is bent or twisted to form said members 80*a*-80*e*. Additionally, the linear material can be bent or twisted to form the junctions 80*f*. For example, the linear material can be looped onto itself to form said junctions 80*f*. However, in other embodiments, the reinforcement structure 80 can consists of a plurality of individual sections that overlap each other. For example, the reinforcement structure 80 can consist of a number of loops made of unidirectional linear material, wherein the loops overlap each other to define the layout of the reinforcement structure 80, as shown in FIG. 4C and discussed further below.

In the illustrated embodiment, the reinforcement structure 80 also includes a top frame 86, as shown in FIG. 2A, though as noted above, the top frame 86 is optional. The top frame 86 preferably has an elongated shape and includes a first elongated member 86*a* and a second elongated member 86*b*. Both members 86*a*, 86*b* extend generally longitudinally and are attached to each other via generally transverse members 86*c*. In the illustrated embodiment, the top frame 86 has a generally oval shape. However, the top frame 86 can have other suitable shapes, such as rectangular. The top frame 86 also preferably defines at least one junction 86*f* along the elongated members 86*a*, 86*b*. In the illustrated embodiment, the top frame 86 defines four junctions 86*f*, two along the first elongated member 86*a* and two along the second elongated member 86*b*. However, the top frame 86 can have any suitable number of junctions 86*f*. As discussed above, in one embodiment a unidirectional filament is looped onto itself to form the junctions 86*f*.

In one embodiment, the right-side and left-side frames 82, 84 are attached to the top frame 86 via the junctions 80*f*, 86*f*. For example, in one embodiment the junctions 80*f* on the second elongated member 80*b* of the right-side frame 82 can be attached to the junctions 86*f* on the first elongated member 86*a* of the top frame 86. Additionally, in one embodiment the junction 80*f* on the third elongated member 80*d* of the right-side frame 82 can be attached to one of the junctions 86*f* on the second elongated member 86*b* of the top frame 86. Likewise, in one embodiment the junctions 80*f* on the second elongated member 80*b* of the left-side frame 84 can be attached to the junctions 86*f* on the second elongated member 86*b* of the top frame 86. Additionally, in one embodiment the junction 80*f* on the third elongated member 80*d* of the left-side frame 84 can be attached to one of the junctions 86*f* on the first elongated member 86*a* of the top frame 86. However, the right-side and left-side frames 82, 84 can be fastened to the top frame 86 using any suitable combination of junctions 80*f*, 86*f*. For example, in another embodiment, the top frame 86 can be fastened to the second elongated members 80*d* of the right-side and left-side frames 82, 84 via the junctions 80*f*, 86*f*.

The junctions 80*f*, 86*f* can be attached with a fastener. For example, the junctions 80*f*, 86*f* can be fastened together with a rivet, such as the snap rivet 90 shown in FIG. 2B. However, other types of rivets and other types of fasteners can also be used, such as screws, clamps, pins, nails and the like. Preferably, the fasteners are made of a rigid and light-weight material. In one embodiment, the fasteners are made of a hard plastic, such as polyethylene. In another embodiment, the junctions 80*f*, 86*f* can be fastened together via an adhesive. Once fastened together, the right-side frame 82, left-side frame 84 and top frame 86 define an assembled reinforcement structure 80.

FIG. 3 illustrates a partially formed helmet body 10. Specifically, FIG. 3 shows right and left bottom foam portions 40 of the right-side and left-side frames 82, 84. In the illustrated embodiment, the helmet body 10 is injection molded about the bottom portions 40 of the right-side and left-side frames 82, 84, as well as about the right-side and left-side trays 72, 74. The foam molding process is can be any process known in the art. One suitable process is discussed further below with reference to FIGS. 6A and 6B, which show one embodiment of a mold used to form the foam portions about the right and left side frames 82, 84. Preferably, the first elongated member 80*a*, and at least a portion of the transverse members 80*c* connecting the first and second elongated members 80*a*, 80*b* are insert molded into said bottom foam portions, while the remainder of the right-side and left-side frames 82, 84 remain exposed. As used herein, "insert molded" means embedding at least a portion of the reinforcement structure 80 in foam so that the foam envelops said portion of the structure 80. In another embodiment, a different portion of the right-side and left-side frames 82, 84 can be insert molded or embedded in the foam portion. For example, in one embodiment said first and second elongated members 80*a*, 80*b* and transverse members 80*c* can be substantially entirely embedded within the bottom foam portions. In one embodiment, the right and left sides of the partially formed helmet body 10 are removed from the mold so that the bottom portions are allowed to partially stiffen. In another embodiment, the bottom portions are allowed to fully harden. The partially formed helmet body 10 can then be inserted into the corresponding mold, and the injection molding process resumed to form the remaining portion of the helmet body 10. For example, foam can be molded onto the remainder of the right-side and left-side frames 82, 84 to form the top section 50 of the completed helmet body 10, as shown in FIGS. 1A-1E. The exposed portions of the right-side and left-side frames 82, 84 are also preferably insert molded onto the foam that forms the top section 50 of the helmet body. Accordingly, in one embodiment, different sections of the body 10 can be formed in sequence. In another embodiment, the entire body 10 can be formed at the same time. For example, foam can be injected in the trays 72, 74 and about the reinforcement structure 80, so that the reinforcement structure 80 is substantially disposed within or embedded in the foam. Accordingly, the reinforcement structure 80 can serve as an internal reinforcement structure.

In one embodiment, the bottom foam portions form the bottom section 40 of the helmet body 10, which interconnects with the subsequently formed top section 50 by at least the reinforcement structure 80. In another embodiment, the combination of the bottom foam portions of the right-side and left-side frames 82, 84 and the exposed portions of the same are insert molded into a foam part that defines the top section 50 of the completed helmet body 10. Accordingly, in one embodiment the helmet body 10 includes multiple foam parts formed as individual layers of a unitary structure molded in successive steps to form said unitary structure. Advantageously, the right-side and left-side frames 82, 84 engage and fasten the different foam portions together. In another embodiment, as discussed above, the body 10 can be formed as a unitary structure.

Though the molding process described above involves molding the bottom portion of the helmet body 10 first, and then molding the top portion of the helmet body 10, other suitable sequences can be used to mold the helmet body 10. For example, in one embodiment, foam having a first density can be injection molded about the top portions of the right and left side frames 82, 84, while leaving the bottom portions of said frames 82, 84 exposed. Then, foam having a second density can be injection molded about the exposed bottom portions of the right and left side frames 82, 84, as well as about the previously formed foam part molded about the top portions of the frames 82, 84. In another embodiment, foam of a single density can be molded about the entire frame 82, 84 in one step.

In one embodiment, the foam used to form the bottom section 40 of the frames 82, 84 has a different density than the foam used to form the top section 50. For example, the foam used to form the bottom section 40 of the frames 82, 84 can have a higher density than the foam used to form the top section 50. In still another embodiment, the bottom section 40 of the frames 82, 84 can be formed with a plurality of foam sections of different densities. Likewise, the top section 50 can be formed with a plurality of foam sections of different densities. Accordingly, in one embodiment different portions of the helmet body 10 can be constructed having a selected foam density.

In a preferred embodiment, the helmet body 10 is constructed using an injection-molding process. However, the helmet body 10 may be constructed using a variety of suitable manufacturing techniques that are known or apparent to one of skill in the art.

In one embodiment, the lower-density foam is first injection molded about a portion of the frames 82, 84, and then the higher-density foam is injection molded about another portion of the frames 82, 84. In another embodiment, the higher-density foam section is first injection molded about a portion of the frames 82, 84, then the lower-density foam is injection molded about another portion of the frames 82, 84. This process can be repeated until the helmet body 10 has been fully formed.

As discussed above, and shown in FIG. 4A, in one embodiment, the structure of linear material 81 can be formed without a reinforcement member 88. In the illustrated embodiment, the structure of linear material 81 includes a least one loop 83 of linear material. Preferably, the loops 83 are disposed on the structure 81 at locations where one foam part having a first density will meet with a second foam part having a second density different from the first density. Accordingly, the loops 83 are preferably positioned along the foam density "border". Advantageously, the loops 83 strengthen the engagement between the structure of linear material 81 and the foam parts in the completed helmet body 10.

Figure 4A:
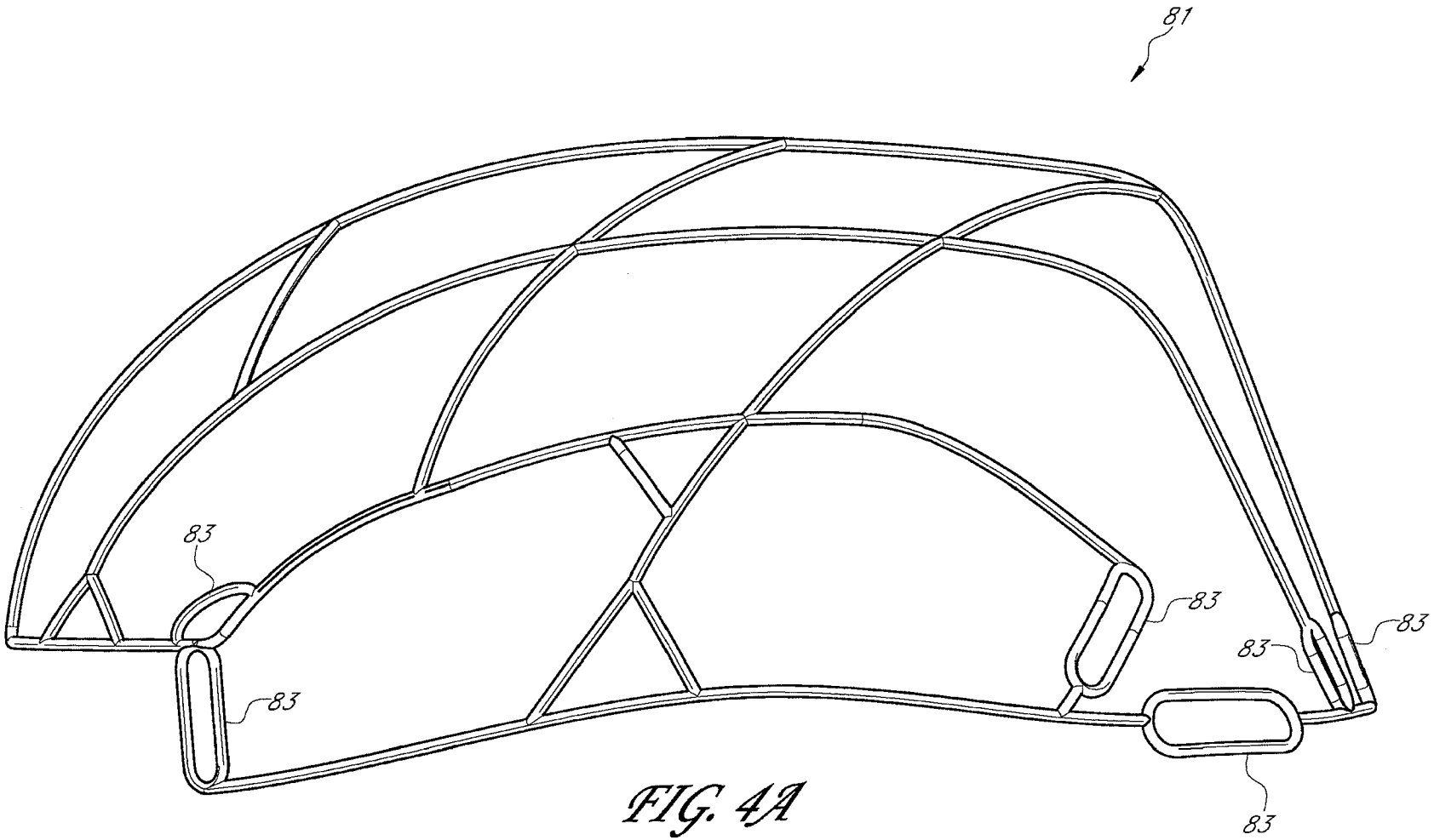
FIG. 4A is a schematic side view of another embodiment of a reinforcement structure used for manufacturing the bicycle helmet of FIG. 1A.
Figure 4B:
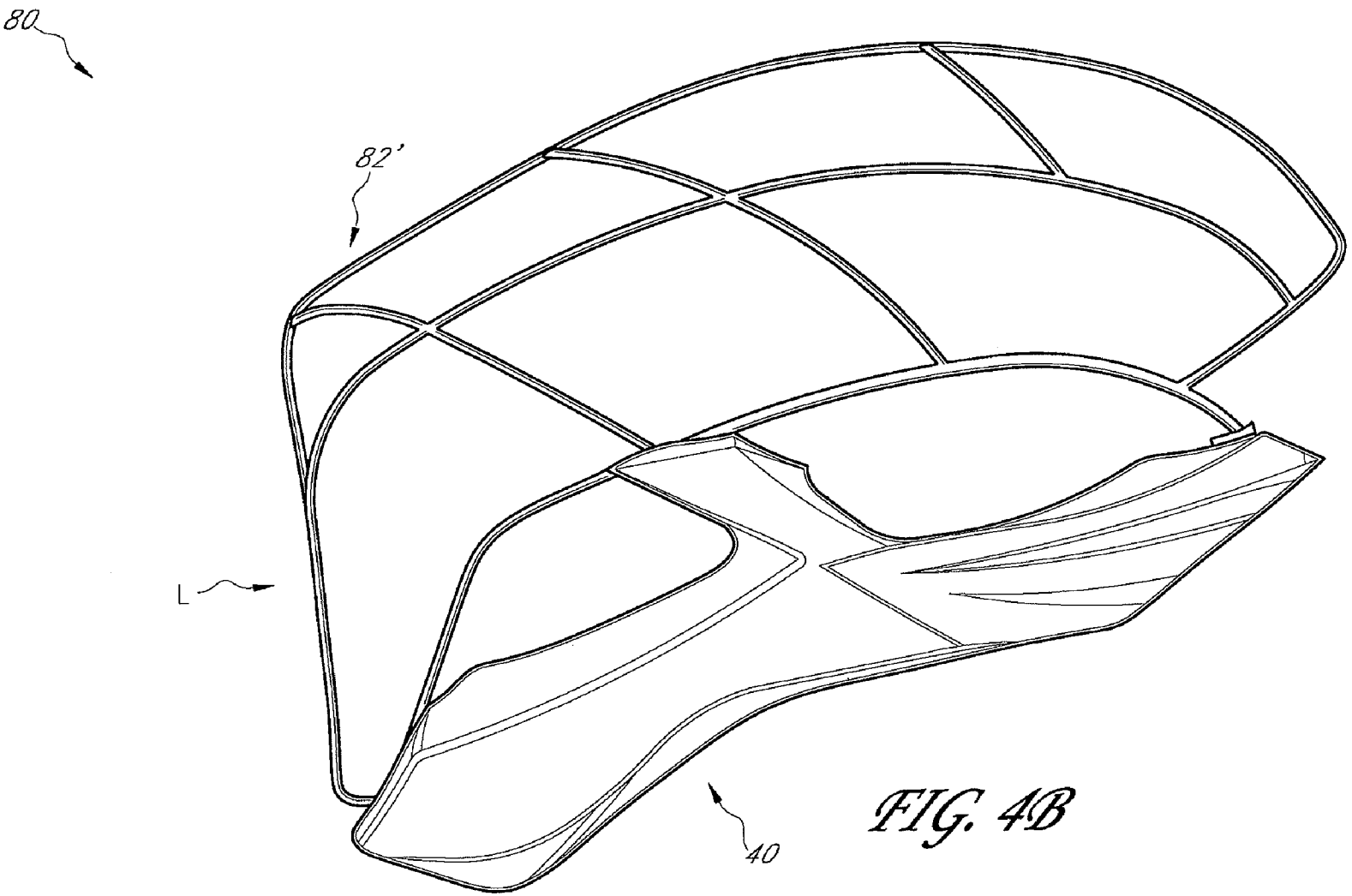
FIG. 4B is a schematic side view of another embodiment of a reinforcement structure used for manufacturing the bicycle helmet of FIG. 1A during an intermediate manufacturing step, the structure having the bottom foam portion molded thereon.
Figure 4C:
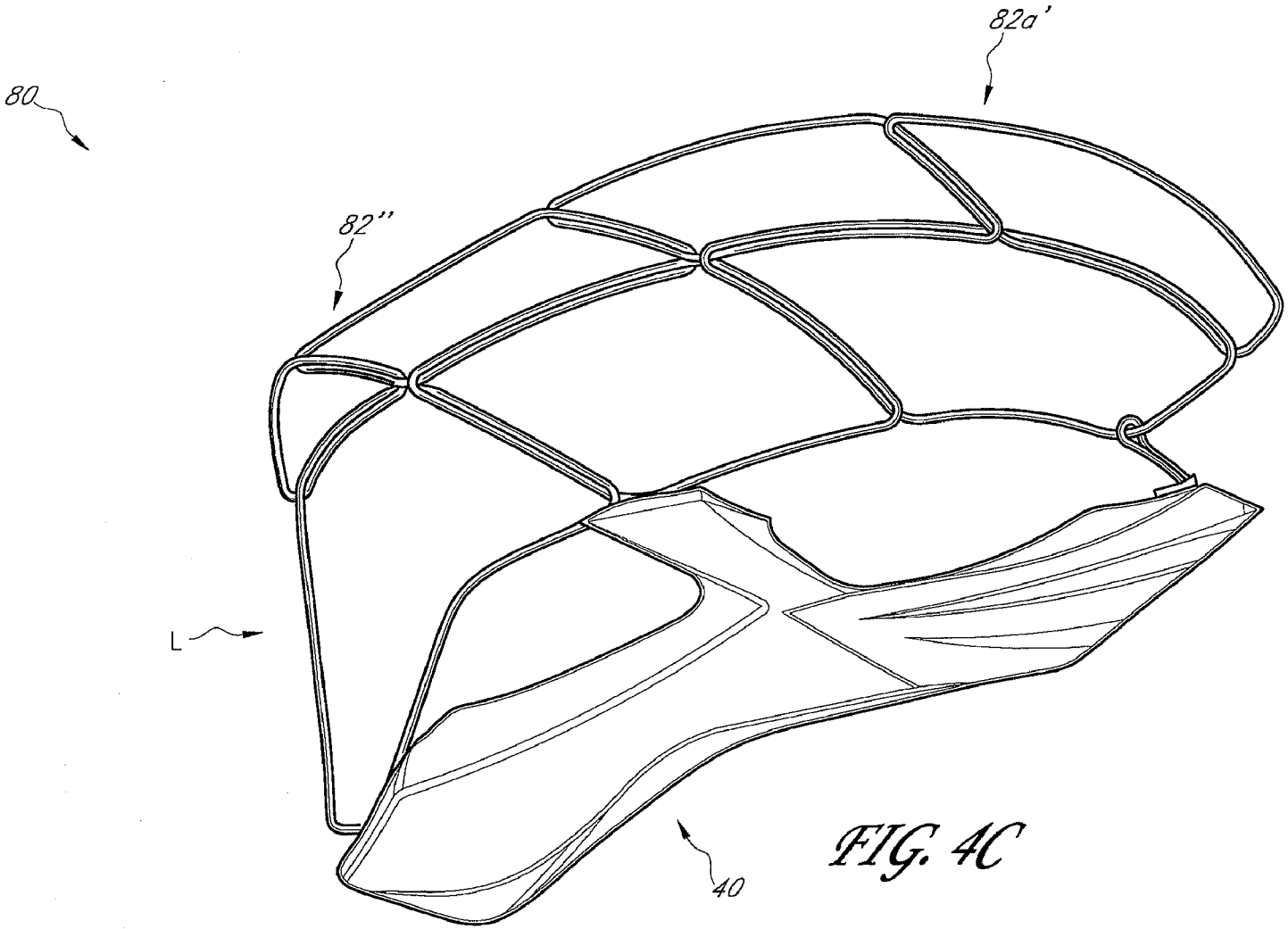
FIG. 4C is a schematic side view of another embodiment of a reinforcement structure used for manufacturing the bicycle helmet of FIG. 1A during an intermediate manufacturing step, the structure having the bottom foam portion molded thereon.

FIG. 4B illustrates another embodiment of the reinforcement structure 80 with a frame 82' of linear material, without a reinforcement member 88. In the illustrated embodiment, the frame 82' corresponds to a right-side frame of a helmet body and is defined by a unidirectional continuous filament. In the illustrated embodiment, the helmet body is in an intermediate manufacturing step, where the bottom foam portion 40 has been molded onto the frame 82', as further discussed below. A left-side frame is preferably a mirror image of the frame 82' and is therefore not shown.

As discussed above, the frame 82' of the helmet body 80 can be made of a continuous unidirectional filament. In another embodiment, shown in FIG. 4C, the frame 82" can consist of multiple loops 82*a'* of linear material, wherein each of the loops 82*a'* is attached to at least another of the loops 82*a'*, so that the loops 82*a'* of linear material overlap with each other. In a preferred embodiment, the loops 82*a'* overlap over a length of between about 3 cm and about 4 cm. However, the loops 82*a'* can overlap over a longer or shorter distance.

Figure 5A:
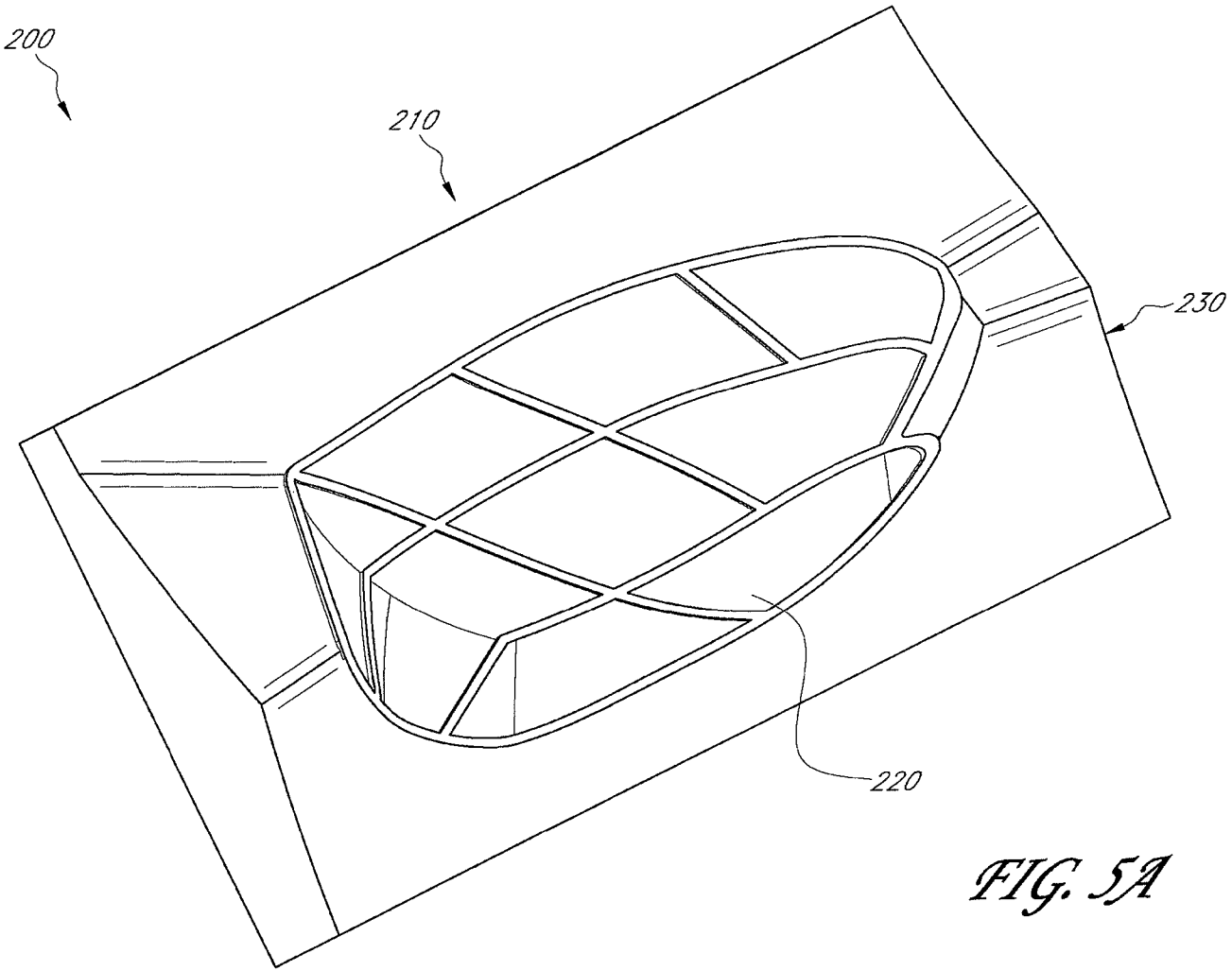
FIG. 5A is a schematic perspective front view of a top portion of a mold for forming the reinforcement structure shown in FIGS. 4A-4C.
Figure 5B:
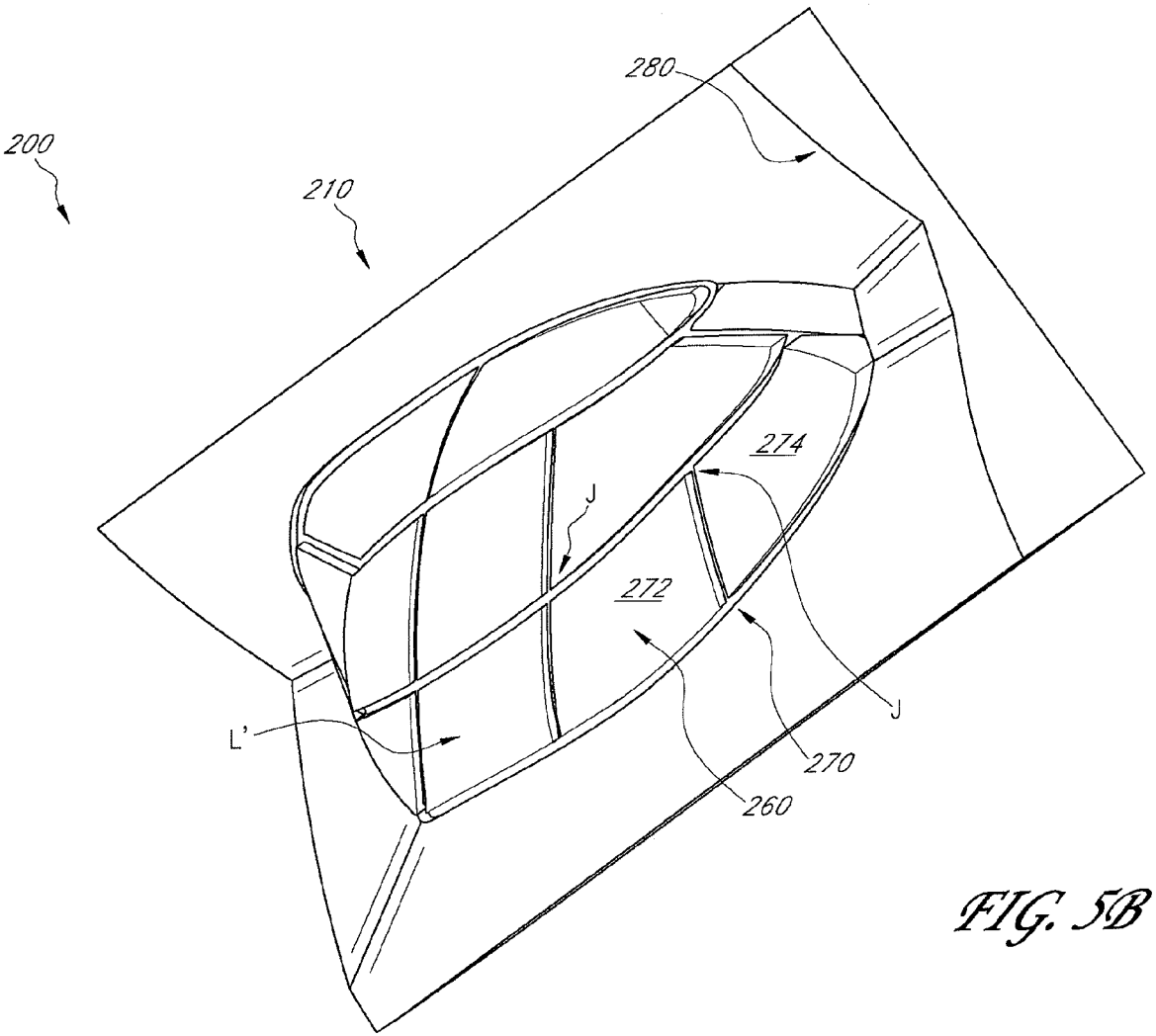
FIG. 5B is a schematic perspective front view of a bottom portion of a mold for forming the reinforcement structure shown in FIG. 4A-4C.

FIGS. 5A-5B illustrate a mold 200 used to form the structure of linear material 81. In the illustrated embodiment, the mold 200 is used to form a right-side reinforcement frame 82', 82" for a helmet body. However, a similarly constructed mold can be used to form a left-side reinforcement frame of the helmet body.

The mold 200 includes a top portion 210 and a bottom portion 250. The top portion 210 defines an outer frame surface 220 and an inner frame surface (not shown) on a side opposite the outer frame surface 220. The top portion 210 also has an outer edge 230.

The bottom portion 250 defines an inner frame surface 260, which includes a plurality of grooves 270 formed thereon. The grooves 270 are oriented to provide a desired layout L', which preferably corresponds to the layout L of the frame 82' of linear material. However, one of ordinary skill in the art will recognize that the grooves 270 can be oriented to provide any desired layout, such as the layout L of the right-side frame 82 and left-side frame 84 described above. The bottom portion 250 also includes and outer edge 280. The top and bottom portions 210, 250 of the mold 200 preferably couple to each other along their edges 230, 280 to form a closed mold.

In one embodiment, continuous linear material is preferably disposed in the grooves 270 of the bottom portion 250 and wound around junctions between intersecting grooves 270, in order to define the desired layout L. In one embodiment, pins are inserted at the junctions J between grooves 270, and the linear material wound around the pins to aid in laying the linear material along the grooves 270. Once the desired layout L is obtained, and the frame 82' cured, said pins can be removed. Such a process can be used to form, for example, the frame 82' shown in FIG. 4B.

In another embodiment, discrete loops of linear material can be disposed along the grooves 270 so as to define the desired layout L. For example a loop of linear material can be laid along a set of grooves 270 that define one section 272 of the layout L. Another loop of linear material can then be laid along another set of grooves 270 that define another section 274 of the layout L. Preferably the loops of linear material are laid within the grooves 270 so that at least a portion of each loop overlaps with a portion of another loop. In a preferred embodiment, said loops of linear material overlap between about 3 cm and about 4 cm. However, in another embodiment, the loops of linear material can overlap less than 3 cm, or more than 4 cm. Such a process can be used to form, for example, the frame 82" shown in FIG. 4C.

After the linear material has been laid within the grooves 270 250, the top portion 210 is coupled to the bottom portion 250 of the mold 200. The linear material within the grooves 270 can then be cured to provide a frame 81, 82', 82" that is substantially rigid. For example, the linear material with the grooves can be heated to harden the linear material into a substantially rigid structure.

Figure 6A:
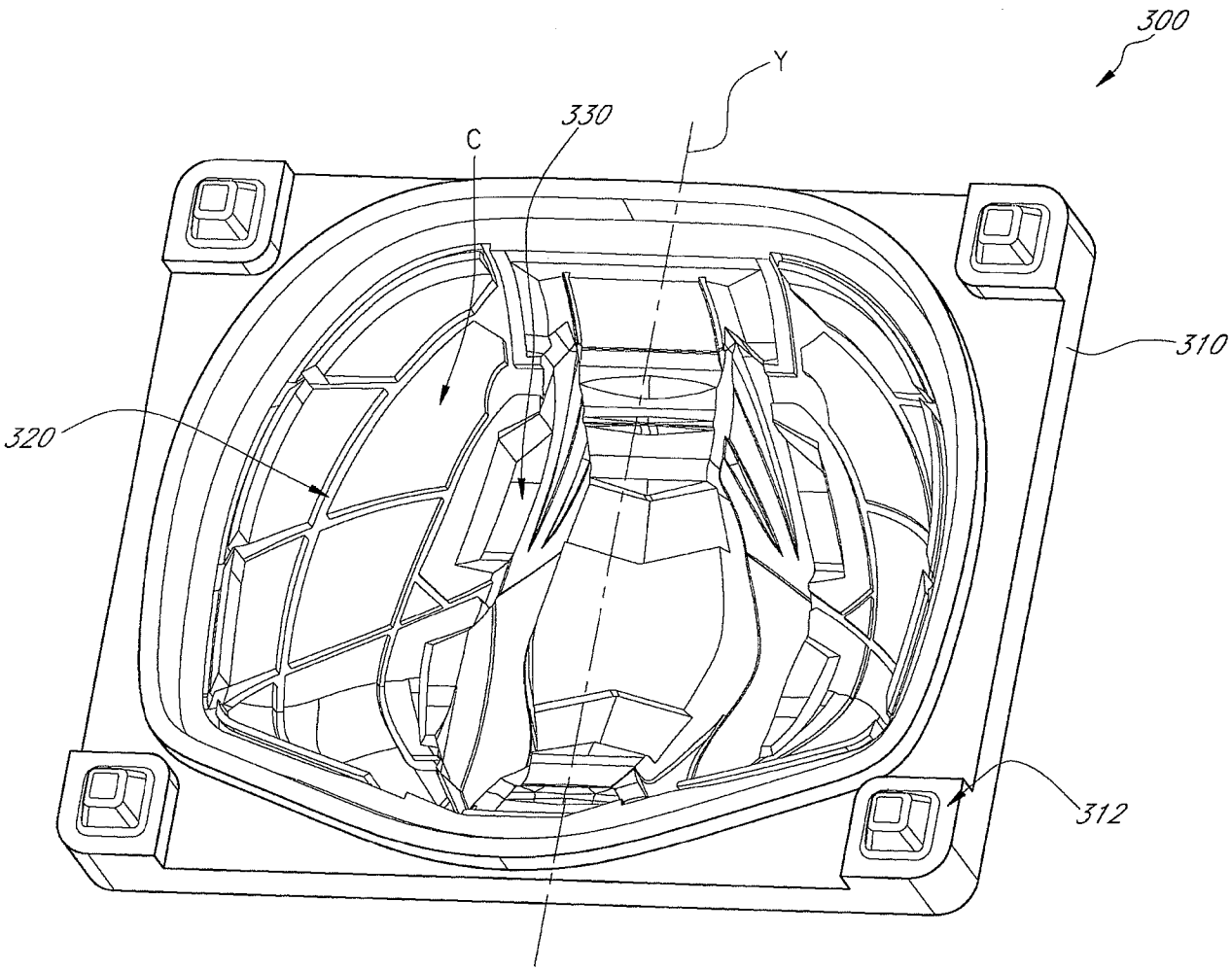
FIG. 6A is a schematic front view of a bottom portion of a mold for forming a foam portion about the reinforcement structure shown in FIGS. 4A-4C.
Figure 6B:
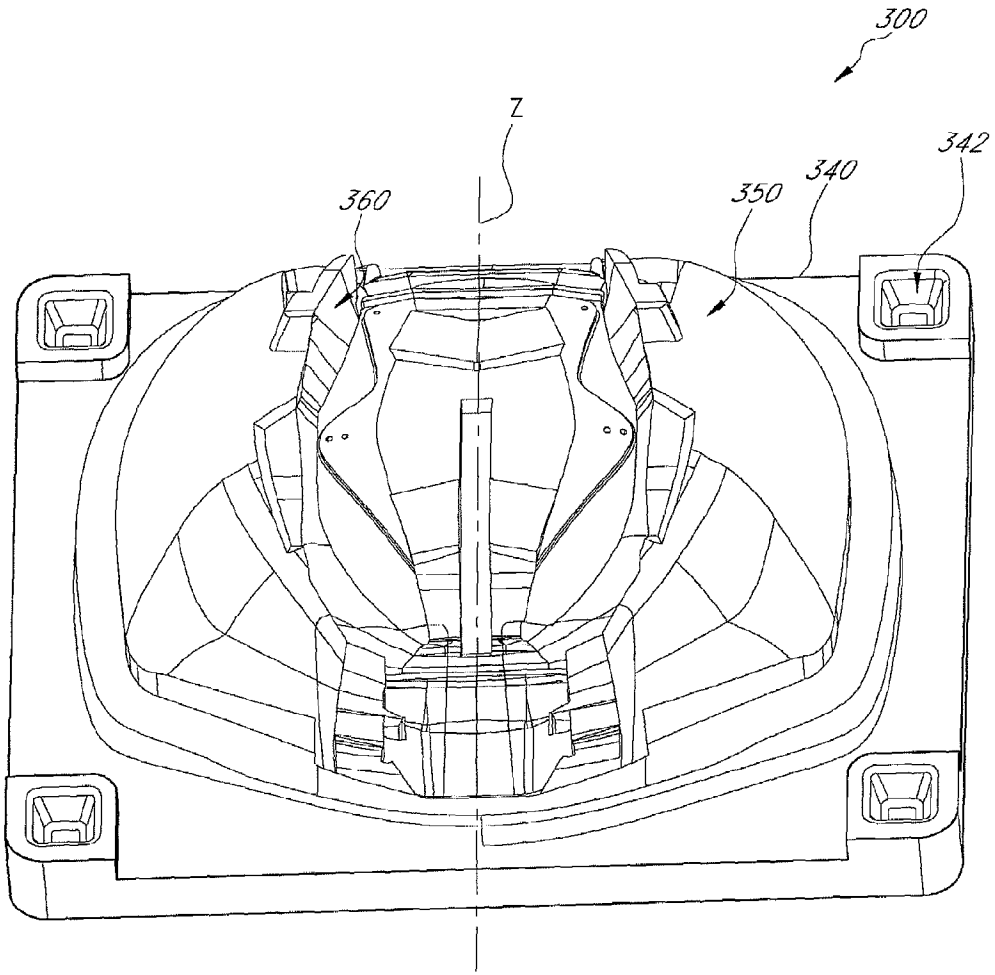
FIG. 6B is a schematic front view of a top portion of a mold for forming a foam portion about the reinforcement structure shown in FIGS. 4A-4C.

FIGS. 6A-6B illustrate one embodiment of a mold 300 used to form a foam section about the structure of linear material 81 or frame 82, 82', 82". Specifically, the mold 300 is sized to form the bottom foam portion 40 about the structure of linear material 81.

The mold 300 preferably includes a bottom portion 310 and a top portion 340. The bottom portion 310 is symmetrical about an axis Y, which divides the bottom portion 310 into two identical halves, and includes fastening members 312 for fastening the bottom portion 310 to the top portion 340. Preferably, each half of the bottom portion 310 includes a concave surface C with grooves 320 formed therein. The grooves 320 form a layout L" equal to the layout L of the structure of linear material 81 or reinforcement frames 82, 82', 82", 84. Each half of the bottom portion 310 also has a recessed portion 330 formed adjacent the layout L" of grooves 320. The recessed portion 330 is preferably recessed relative to the concave surface C.

The top portion 340 of the mold 300 is likewise symmetrical about an axis Z, which divides the top portion 340 into identical halves, and includes fastening members 342 sized to engage the fastening members 312 of the bottom portion 310, so as to form the assembled mold 300. The top portion 340 preferably includes a convex surface 350 with a contour corresponding to the contour defined by the concave surface C. The top portion 340 also includes protrusions 360, which extend out from the contour of the convex surface 350.

Figure 7A:
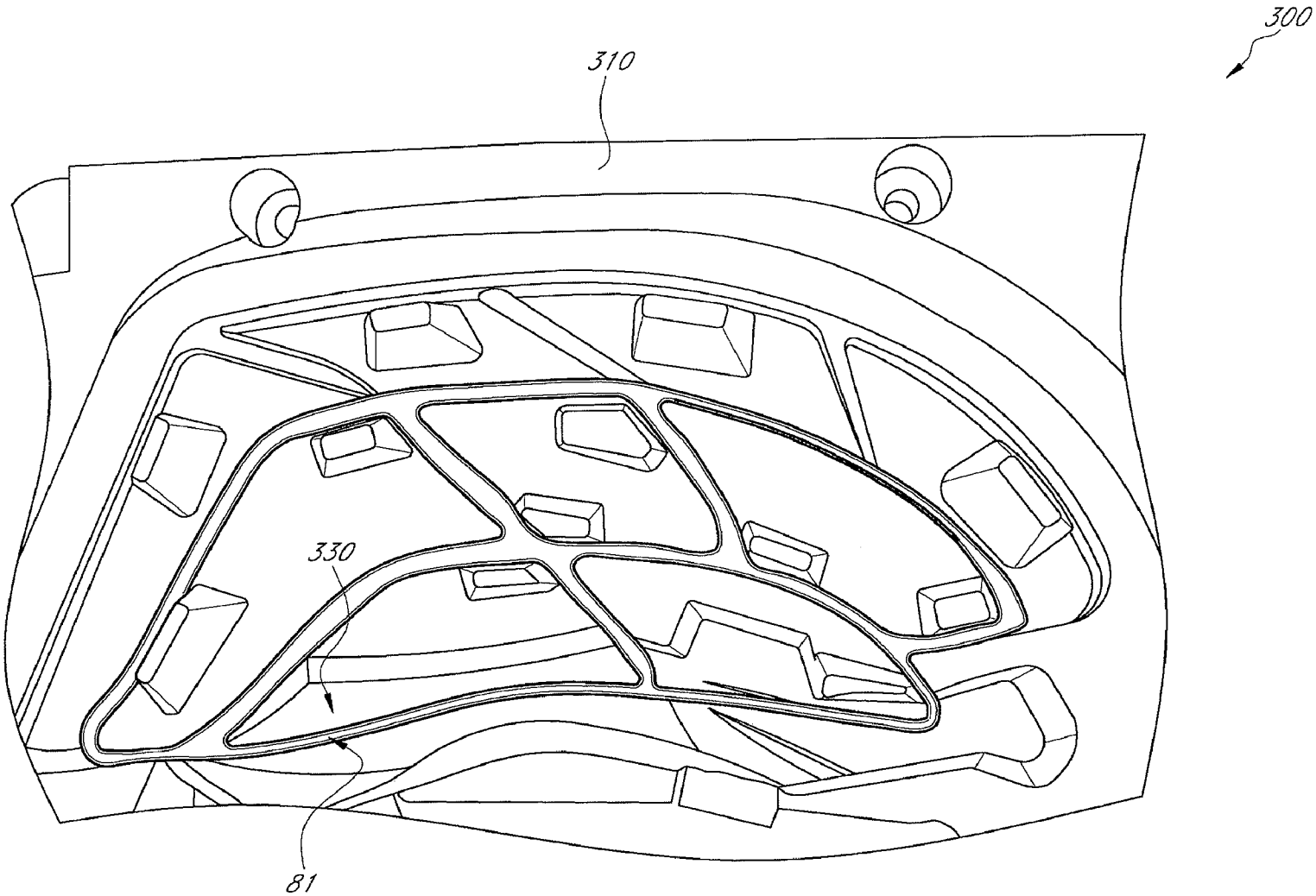
FIG. 7A is a schematic front view of a bottom portion of the mold in FIG. 6A, with a reinforcement structure disposed therein, prior to formation of the foam portion about the reinforcement structure.

Once the structure of linear material 81 has been formed using the mold 200, the structure 81 is placed in the grooves 320 of the bottom portion 310 of the mold 300. As the layout L" of the grooves 320 is substantially equal to the layout L of the structure 81, the structure 81 readily fits within the grooves 320. Preferably, the structure 81 fits within the layout L" of the grooves 320 such that a portion of the structure 81 is not disposed in the grooves 320, but instead extends over the recessed portion 330, as shown in FIG. 7A.

Figure 7B:
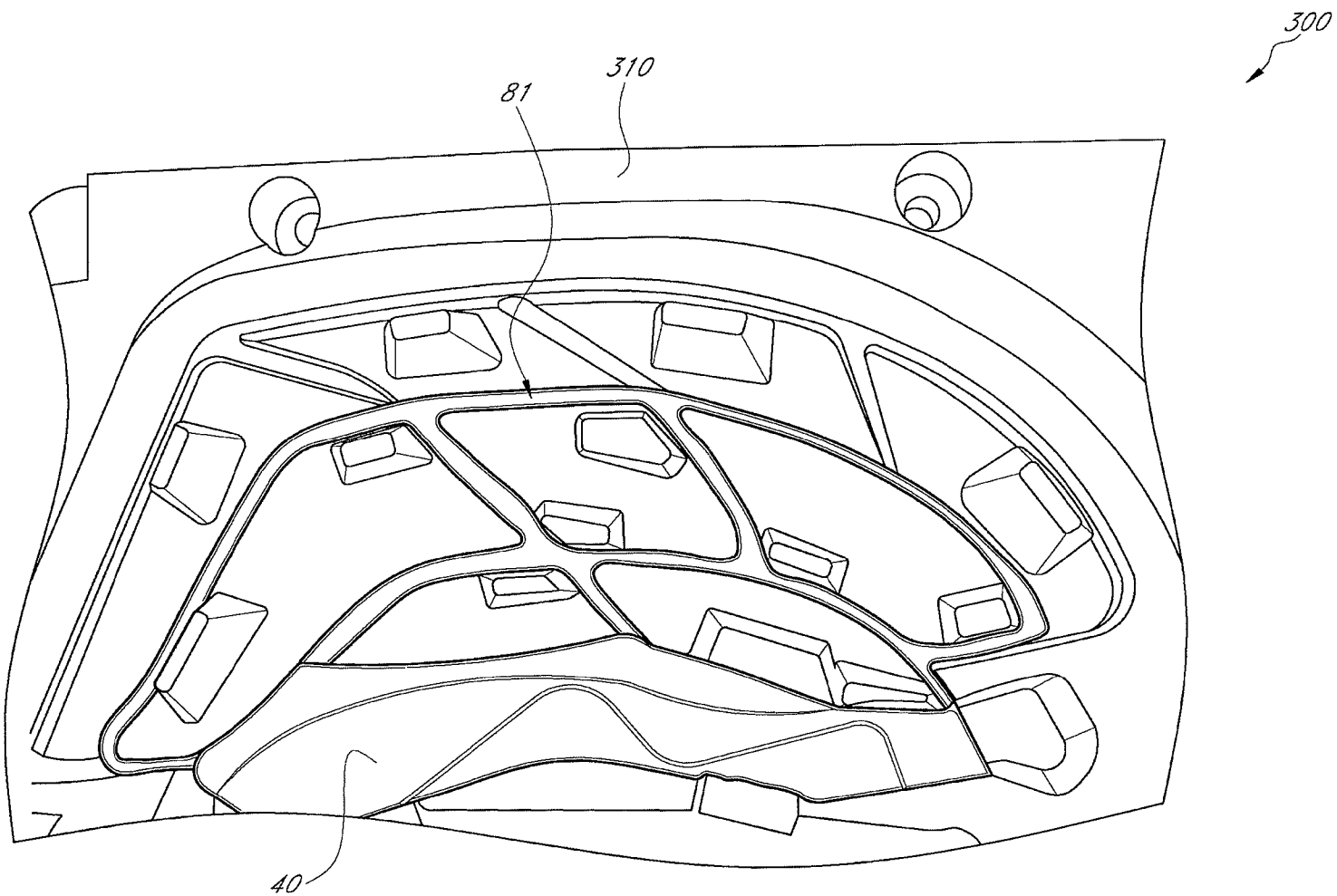
FIG. 7B is a schematic front view of the bottom portion in FIG. 7A, following the formation of the foam portion about the reinforcement structure.

The top portion 340 is coupled to the bottom portion 310. In one embodiment, the convex surface 350 of the top portion 340 contacts the concave surface C of the bottom portion 310, which maintains the structure 81 in place and inhibits its withdrawal from the layout L" of the grooves 320. Foam of a desired density is then injected into the recessed portion 330 so as to form the bottom portion 40 of the helmet body 10. As shown in FIG. 7B, the bottom portion 40 is formed about the exposed portion of the structure 81 that extended over the recessed portion 330.

The assembly of the frame 82, 82', 82" and bottom portion 40 can then be withdrawn from the mold 300 and transferred to another mold (not shown) to form the top portion 50 of the helmet body 10. This mold can be similar in construction to the mold 300 and include a recessed portion over which the exposed portion of the structure 81 can be placed, so that foam can similarly be injection molded about the exposed portions of the structure. In another embodiment, a mold (not shown)

can be sized and shaped so as to allow the injection molding of foam about the entire frame 82, 82', 82" to form the helmet body 10 as a unitary piece, instead of in parts as described above.

In one embodiment, shown in FIG. 1B, an outer shell 500 preferably covers at least a portion of an outer surface of the body 10 and, thus, defines at least a portion of the outer surface of the helmet 100. In one embodiment, the shell is continuous and overlays an outer surface of the body 10. The shell can provide protection to the body 10 and improve the overall appearance of the helmet 100. In addition, the shell may also provide an energy-absorbing function. Further, the shell can function as an external frame of the helmet body 10. In one embodiment, the shell can be a relatively thin layer of a plastic material. Additionally an average thickness of the shell can desirably be substantially less than an average thickness of the body 10. In one arrangement, the shell may be injection molded onto the helmet body 10 after it has been formed in a previous process step.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In particular, while the present helmet has been described in the context of particularly preferred embodiments, the skilled artisan will appreciate, in view of the present disclosure, that certain advantages, features, and aspects of the helmet may be realized in a variety of other applications, many of which have been noted above. Additionally, it is contemplated that various aspects and features of the invention described can be practiced separately, combined together, or substituted for one another, and that a variety of combination and sub-combinations of the features and aspects can be made and still fall within the scope of the invention. Additionally, it is contemplated that the sequence of steps in the construction of the helmet can be varied and still fall within the scope of the invention. For example, the different sections of the helmet body can be formed in any desirable sequence, such as forming the top section of the helmet first and then forming the bottom section of the helmet. Thus, it is intended that the scope of the present invention herein disclosed should not be limited by the particular disclosed embodiments described above, but should be determined only by a fair reading of the claims.

What is claimed is:

1. A bicycle helmet, comprising:

a body having a concave inner surface configured to permit the helmet to fit a user's head; and a reinforcement structure comprising a plurality of frames interconnected with each other, at least one of the plurality of frames comprising a unidirectional filament, the unidirectional filament forming a plurality of loops, at least two of the loops overlapping with each other, wherein the reinforcement structure engages the body.

2. The helmet of claim 1, wherein the reinforcement structure is embedded in the body.

3. The helmet of claim 2, wherein the body comprises an expanded foam material formed about substantially the entire reinforcement structure.

4. The helmet of claim 1, wherein the filament comprises Kevlar.

5. The helmet of claim 1, wherein the filament comprises carbon fiber.

6. The helmet of claim 1, wherein the filament comprises fiberglass.

7. The helmet of claim 1, wherein the filament comprises a combination of at least two materials chosen from the group consisting of Kevlar, carbon fiber and fiberglass.

8. The helmet of claim 1, wherein the filament is hand-laid.

9. The helmet of claim 1, wherein the plurality of frames comprise loops of linear material.

10. The helmet of claim 9, wherein one of said loops overlaps with another of said loops to form said structure.

11. The helmet of claim 10, wherein the loops overlap between about 3 cm and about 4 cm with each other.

12. The helmet of claim 1, wherein the plurality of frames are interconnected by plastic rivets.

13. A bicycle helmet, comprising:

a body having a concave inner surface configured to permit the helmet to fit a user's head; and a reinforcement structure embedded in the body, the reinforcement structure comprising a continuous unidirectional filament that forms a plurality of loops, at least two of the loops overlapping with each other, wherein the unidirectional filament engages the body.

14. The helmet of claim 13, wherein the filament comprises Kevlar.

15. The helmet of claim 13, wherein the filament comprises carbon fiber.

16. The helmet of claim 13, wherein the filament comprises fiberglass.

17. The helmet of claim 13, wherein the filament comprises a combination of at least two materials chosen from the group consisting of Kevlar, carbon fiber and fiberglass.

18. The helmet of claim 13, wherein the filament is hand-laid.

19. The helmet of claim 13, wherein the reinforcement structure comprises a plurality of frames, the frames interconnected with each other.

20. The helmet of claim 19, wherein the plurality of frames are interconnected via plastic rivets.

21. A method of manufacturing a bicycle helmet, comprising:

forming a reinforcement structure comprising a plurality of frames interconnected with each other, the reinforcement structure comprising a unidirectional filament that forms a plurality of loops, at least two of the loops overlapping with each other; and embedding the reinforcement structure in a body having a concave inner surface and a convex outer surface, the reinforcement structure engaging at least a portion of the body.

22. The method of claim 21, wherein the unidirectional filament is continuous.

23. The method of claim 21, wherein forming the reinforcement structure comprising the plurality of frames includes attaching a plurality of loops of linear material to each other so that one of said loops overlaps with another of said loops to form said reinforcement structure.

24. The method of claim 21, wherein the unidirectional filament comprises a material chosen from the group consisting of Kevlar, carbon fiber and fiberglass.

25. The method of claim 24, wherein the unidirectional filament comprises a combination of at least two materials chosen from the group.

26. The method of claim 21, wherein forming the reinforcement structure includes hand-laying the unidirectional filament into a mold to form a frame having a desired layout, and curing the frame.

* * * * *